US011446843B2

(12) United States Patent
Schlough et al.

(10) Patent No.: US 11,446,843 B2
(45) Date of Patent: Sep. 20, 2022

(54) MATERIAL LOADING APPARATUS

(71) Applicant: Park Industries, Inc., St. Cloud, MN (US)

(72) Inventors: Michael Schlough, St. Cloud, MN (US); Kevin Matz, Clearwater, MN (US)

(73) Assignee: Park Industries, Inc., St. Cloud, MN (US)

( * ) Notice: Subject to any disclaimer, the term of this patent is extended or adjusted under 35 U.S.C. 154(b) by 812 days.

(21) Appl. No.: 16/272,592

(22) Filed: Feb. 11, 2019

(65) Prior Publication Data

US 2020/0039110 A1 Feb. 6, 2020

Related U.S. Application Data

(63) Continuation of application No. 15/000,764, filed on Jan. 19, 2016, now Pat. No. 10,201,914.
(Continued)

(51) Int. Cl.
*B24C 1/04* (2006.01)
*B28D 7/04* (2006.01)
(Continued)

(52) U.S. Cl.
CPC ..... *B28D 7/043* (2013.01); *B24B 41/06* (2013.01); *B24B 41/068* (2013.01); *B24C 1/045* (2013.01); *B28D 1/043* (2013.01); *B28D 7/02* (2013.01)

(58) Field of Classification Search
CPC ..... B24B 41/06; B24B 41/068; B24C 1/04; B24C 1/045; B28D 1/043; B28D 7/02; B28D 7/04; B28D 7/043
(Continued)

(56) References Cited

U.S. PATENT DOCUMENTS 61,912 A 2/1867 Yaman
1,095,415 A 5/1914 Parker
(Continued)

FOREIGN PATENT DOCUMENTS

CH 657 806 A5 9/1986
CH 658 221 A5 10/1986
(Continued)

OTHER PUBLICATIONS

ACIMM News, 44 pages (Jul./Sep. 1999).
(Continued)

*Primary Examiner* — Eileen P Morgan
(74) *Attorney, Agent, or Firm* — Merchant & Gould P.C.

(57) ABSTRACT

A material loading apparatus includes a movable material support surface that is pivotally mounted to the frame. The loading apparatus also includes a first link that extends between the support surface and the frame and is pivotally connected to the support surface at a first end of the first link and pivotally connected to the frame at a second end of the first link. The loading apparatus also includes a second link that extends between the support surface and the frame and is pivotally connected to the support surface at a first end of the second link and pivotally connected to the frame at a second end of the second link. The loading apparatus also includes an actuator that is pivotally connected to the frame and configured to move the support surface between a generally horizontal position and a generally vertical position.

5 Claims, 9 Drawing Sheets

Related U.S. Application Data

(60) Provisional application No. 62/105,533, filed on Jan. 20, 2015.

(51) Int. Cl.
*B28D 7/02* (2006.01)
*B24B 41/06* (2012.01)
*B28D 1/04* (2006.01)

(58) Field of Classification Search
USPC ..... 451/75, 380, 405, 414; 125/35; 108/5, 6
See application file for complete search history.

(56) References Cited

U.S. PATENT DOCUMENTS 1,263,461 A 4/1918 Parker
1,491,287 A 4/1924 Canning
1,765,890 A 6/1930 Vates
1,862,583 A 6/1932 Skriba
1,909,001 A 5/1933 Nelson
2,187,299 A 1/1940 Burkhardt
2,344,003 A 3/1944 Sheptinsky
2,372,699 A 4/1945 Wiken et al.
2,378,070 A 6/1945 Eastwood
2,408,530 A 10/1946 Owen et al.
2,444,598 A 7/1948 Eyles et al.
2,450,371 A 9/1948 Coates
2,455,113 A 11/1948 Coates
2,460,386 A 2/1949 Hillquist
2,557,251 A 6/1951 Baker et al.
2,686,095 A * 8/1954 Carlson ..... B28D 7/043 108/4
2,693,056 A 11/1954 Gagne
2,708,332 A 5/1955 Riddell et al.
2,716,402 A 8/1955 Harrison, Sr. et al.
2,840,960 A 7/1958 Booth
2,998,813 A 9/1961 Wilson
3,127,886 A 4/1964 Miller
3,136,098 A 6/1964 Backer
3,289,662 A 12/1966 Garrison
3,483,858 A 12/1969 Jansen
3,491,807 A 1/1970 Underwood
3,534,789 A 10/1970 Morris
3,547,096 A 12/1970 Ronzani
3,575,075 A 4/1971 Fisher
3,634,975 A 1/1972 Hensley
3,690,356 A 9/1972 Holan
3,722,496 A 3/1973 Schuman
3,738,349 A 6/1973 Cooper et al.
3,748,789 A 7/1973 Wada et al.
3,761,675 A 9/1973 Mason et al.
3,776,072 A 12/1973 Gerber et al.
3,877,334 A 4/1975 Gerber
3,896,783 A 7/1975 Manning
3,960,407 A 6/1976 Noren
4,031,933 A 6/1977 Piche
4,033,319 A 7/1977 Winter
4,074,858 A 2/1978 Burns et al.
4,107,883 A 8/1978 Bein
4,112,797 A 9/1978 Pearl
4,131,103 A 12/1978 Ishizuka
4,176,883 A 12/1979 Liesveld
4,204,448 A 5/1980 Pearl
4,244,102 A 1/1981 Bolles
4,280,735 A 7/1981 Löbbe
4,290,496 A 9/1981 Briggs
4,309,600 A 1/1982 Perry et al.
4,312,254 A 1/1982 Pearl
4,372,174 A 2/1983 Cymbalisty et al.
4,397,245 A 8/1983 Washburn
4,409,875 A 10/1983 Nakajima et al.
4,436,078 A 3/1984 Bourke
4,446,845 A 5/1984 Harding
4,555,143 A 11/1985 Wrulich et al.
4,559,920 A 12/1985 Toncelli et al.
4,570,609 A 2/1986 Hogue
4,597,225 A 7/1986 Toncelli
4,607,792 A 8/1986 Young, III
4,619,163 A 10/1986 Brown
4,620,525 A 11/1986 Toncelli
4,660,539 A 4/1987 Battaglia
4,663,893 A 5/1987 Savanick et al.
4,738,218 A 4/1988 Toncelli
4,741,577 A 5/1988 Sato et al.
4,782,591 A 11/1988 DeVito et al.
4,794,964 A 1/1989 Wolf
4,838,968 A 6/1989 Nelson
4,870,946 A 10/1989 Long et al.
4,920,947 A 5/1990 Scott et al.
4,924,843 A * 5/1990 Waren ..... B28D 1/047 125/35
4,940,038 A 7/1990 O'Keefe
4,969,380 A 11/1990 Halligan
5,003,729 A 4/1991 Sherby
5,022,193 A 6/1991 Toncelli
5,080,085 A 1/1992 Lovato
5,085,008 A 2/1992 Jennings et al.
5,127,391 A 7/1992 O'Keefe
5,189,939 A 3/1993 Allen, Jr.
5,191,873 A 3/1993 Browning et al.
5,197,393 A 3/1993 Yeakle
5,269,211 A 12/1993 Flaming
5,291,694 A 3/1994 Hosoya et al.
5,302,228 A 4/1994 Holland
5,332,293 A 7/1994 Higgins et al.
5,338,179 A 8/1994 Luca
5,349,788 A * 9/1994 Nedo ..... B26F 3/008 451/75
5,411,432 A 5/1995 Wyatt et al.
5,435,951 A 7/1995 Toncelli
5,472,367 A 12/1995 Slocum et al.
5,575,538 A 11/1996 Gilbert et al.
5,595,170 A 1/1997 Lupi
5,601,014 A 2/1997 Stevens et al.
5,635,086 A 6/1997 Warren, Jr. et al.
5,690,092 A 11/1997 Ogyu
5,720,648 A 2/1998 Green et al.
5,782,673 A 7/1998 Warehime
5,802,939 A 9/1998 Wiand et al.
5,868,056 A 2/1999 Pfarr et al.
5,921,228 A 7/1999 Watson
5,934,346 A 8/1999 Windeisen et al.
6,000,387 A 12/1999 Lee
6,006,735 A 12/1999 Schlough et al.
6,068,547 A 5/2000 Lupi
6,073,621 A 6/2000 Cetrangolo
6,102,023 A 8/2000 Ishiwata et al.
6,131,557 A 10/2000 Watson
6,152,127 A 11/2000 Fuhrman et al.
6,152,804 A 11/2000 Okuyama
6,155,245 A 12/2000 Zanzuri
6,170,478 B1 1/2001 Gorder
6,186,136 B1 2/2001 Osborne
6,222,155 B1 4/2001 Blackmon et al.
6,263,866 B1 7/2001 Tsao
6,306,015 B1 10/2001 Bushell
6,318,351 B1 11/2001 Baratta
6,361,404 B1 3/2002 Ishiwata et al.
6,371,103 B1 4/2002 Lupi
6,375,558 B1 4/2002 Baratta
6,427,677 B1 8/2002 O'Banion et al.
6,439,218 B1 8/2002 Hulett
6,457,468 B1 10/2002 Goldberg
6,547,337 B2 4/2003 Welch, Jr.
6,550,544 B1 4/2003 Saf
6,561,287 B2 5/2003 DeBlasio
6,561,786 B2 5/2003 Ciccarello
6,595,196 B2 7/2003 Bath
6,598,597 B1 7/2003 Marocco et al.
6,612,212 B1 9/2003 Wiand et al.
6,637,424 B1 10/2003 Fuhrman et al.
6,659,099 B2 12/2003 Holmes
6,691,695 B2 2/2004 Buechel
6,752,140 B1 6/2004 Fuhrman et al.

(56) References Cited

U.S. PATENT DOCUMENTS

| | | | |
|---|---|---|---|
| 6,863,062 | B2 | 3/2005 | Denys |
| 6,945,858 | B1 | 9/2005 | Holmes |
| 6,955,167 | B2 | 10/2005 | Baratta |
| 7,018,279 | B2 | 3/2006 | Baratta |
| 7,056,188 | B1 | 6/2006 | Triplett et al. |
| 7,082,939 | B2 | 8/2006 | Dossena et al. |
| 7,114,494 | B2 | 10/2006 | Baratta |
| 7,121,920 | B1 | 10/2006 | Triplett et al. |
| 7,219,585 | B1 * | 5/2007 | Kelly ..... B27B 5/188 125/35 |
| 7,232,361 | B1 | 6/2007 | Triplett et al. |
| 7,255,253 | B2 | 8/2007 | Wirsam |
| 7,550,106 | B2 | 6/2009 | Toncelli et al. |
| 7,748,373 | B2 | 7/2010 | Toncelli |
| 7,771,249 | B2 | 8/2010 | Schlough et al. |
| 7,841,264 | B2 | 11/2010 | Kim et al. |
| 2003/0092364 | A1 | 5/2003 | Erickson et al. |
| 2003/0131839 | A1 | 7/2003 | Steiner et al. |
| 2003/0168054 | A1 | 9/2003 | Governo et al. |
| 2003/0188893 | A1 | 10/2003 | DeBlasio |
| 2003/0202091 | A1 | 10/2003 | Garcia et al. |
| 2004/0187856 | A1 | 9/2004 | Schlough et al. |
| 2005/0247003 | A1 | 11/2005 | Holmes |
| 2006/0135041 | A1 | 6/2006 | Boone et al. |

FOREIGN PATENT DOCUMENTS

| | | | |
|---|---|---|---|
| CH | 677 897 | A5 | 7/1991 |
| CN | 1047643 | A | 12/1990 |
| DE | 33 32 051 | A1 | 3/1984 |
| DE | 40 21 302 | A1 | 1/1992 |
| DE | 41 02 607 | A1 | 10/1992 |
| DE | 43 08 580 | A1 | 9/1994 |
| DE | 43 32 630 | A1 | 3/1995 |
| DE | 196 03 93 3 | A1 | 8/1997 |
| DE | 197 10 425 | A1 | 9/1998 |
| EP | 0 062 953 | A2 | 10/1982 |
| EP | 0 142 570 | A1 | 5/1985 |
| EP | 0 517 048 | B1 | 10/1996 |
| EP | 0 684 340 | B1 | 1/2000 |
| EP | 1 125 706 | A2 | 8/2001 |
| EP | 1 136 215 | A2 | 9/2001 |
| EP | 1 415 780 | A2 | 5/2004 |
| FR | 517.397 | | 5/1921 |
| FR | 1.104.039 | | 11/1955 |
| FR | 2.111.813 | | 6/1972 |
| FR | 2 548 073 | | 1/1985 |
| FR | 2 644 723 | | 9/1990 |
| GB | 842982 | | 8/1960 |
| GB | 880892 | | 10/1961 |
| GB | 2 125 850 | | 3/1984 |
| JP | 52-16091 | | 2/1977 |
| JP | 55-125417 | | 9/1980 |
| JP | 60-92404 | | 5/1985 |
| JP | 60-162602 | | 8/1985 |
| JP | 60-167744 | | 8/1985 |
| JP | 1-252376 | | 10/1989 |
| JP | 5-185421 | | 7/1993 |
| JP | 6-63934 | | 3/1994 |
| JP | 6-155448 | | 6/1994 |
| JP | 6-270138 | | 9/1994 |
| JP | 6-297449 | | 10/1994 |
| JP | 7-1441 | | 1/1995 |
| JP | 2003-314998 | | 11/2003 |
| WO | WO 2005/014252 | | 2/2005 |
| WO | WO 2006/043294 | | 4/2006 |
| WO | WO 2008/002291 | | 1/2008 |
| WO | WO-2020261079 | A1 * | 12/2020 |

OTHER PUBLICATIONS

Advanced Stone Technologies, Breton S.p.A., 12 pages (Admitted as prior art as of Mar. 16, 2007).
Automatic Block Cutting Machine DBC Series SBC Series, Wuuhersin Machinery Manufactory Co., Ltd., 6 pages (Admitted as prior art as of Mar. 16, 2007).
Automatic Bridge Saw "Teorema 35", Blandini S.r.l., 5 pages (Dec. 10, 2000).
Block Cutting Machine for Granite, Barsanti Macchine, 1 page (Admitted as prior art as of Mar. 16, 2007).
Bufalo-M, Gregori S.p.A., 12 pages (Admitted as prior art as of Mar. 16, 2007).
Combicut DJ/NC 2 in 1, Breton S.p.A., 1 page (Admitted as prior art as of Mar. 16, 2007).
Combicut DJ/NC, Breton S.p.A., ISO 9001:2000, Cert. N. 0056, 1 page (Admitted as prior art as of Mar. 16, 2007).
Drastically increase the production of your CNC Machine!, High Tech Stone, Inc., 1 page (Admitted as prior art as of Mar. 16, 2007).
Eagle—Traveling Bridge Diamond Saw, Park Industries, Inc., 2 pages (Admitted as prior art as of Mar. 16, 2007).
Fresa A Ponte Bridge Milling Machine, Strathesys 80/35, Blandini S.r.l., 4 pages (Admitted as prior art as of Mar. 16, 2007).
Fresatrice Automatica A Ponte, Blandini S.r.l., 4 pages (Admitted as prior art as of Mar. 16, 2007).
Jaguar—Gantry Diamond Saw, Park Industries, Inc., 2 pages (Admitted as prior art as of Mar. 16, 2007).
Joycut FS/NC 500, Breton, S.p.A., 5 pages (2006).
Machines for Everyone, Machines for Everything, Pedrini, 18 pages (Admitted as prior art as of Mar. 16, 2007).
Marble Technologies, BV Bombieri & Venturi, pp. 1-7 (Admitted as prior art as of Mar. 16, 2007).
Mod. MAYA—rifilatrici/trimming machine, Zomato, 4 pages (May 1992).
Northwood Stoneworks, http://www.northwoodstoneworks.com, Northwood Machine Manufacturing Company, 3 pages (Copyright 2004).
Precision Sawing and Polishing Machinery for Today's Industry (SSI-104), Sawing Systems Inc., pp. 1-19 (Admitted as prior art as of Mar. 16, 2007).
Precision Sawing and Polishing Machinery for Today's Industry (SSI-106), Sawing Systems Incorporated, pp. 1-27 (Admitted as prior art as of Mar. 16, 2007).
Predator—Traveling Bridge Diamond Saw, Park Industries, 2 pages (Admitted as prior art as of Mar. 16, 2007).
Python—Traveling Bridge Diamond Saw, Park Industries, 2 pages (Admitted as prior art as of Mar. 16, 2007).
S4C Hydraulic Block-Cutter with Uprights, Officine Meccaniche F.LLI Zambon S.N.C., 8 pages (Admitted as prior art as of Mar. 16, 2007).
Sawing Systems Incorporated, Ad—"The Source for Quality Sawing, Routing and Polishing Equipment," Mar. 2005, 1 Page.
Sawing Systems Incorporated, Catalog—"Precision Sawing and Polishing Machinery for Today's Industry," Admitted as Prior Art: Mar. 30, 2007, 28 Pages.
SawJET™ Technology, http://www.northwoodstoneworks.com/SawJETS.html, Northwood Machine Manufacturing Company, 5 pages (Copyright 2006).
SIMEC Book General Catalogue Stone, SIMEC S.p.A., pp. 1-50 (Admitted as prior art as of Mar. 16, 2007).
Speedycut FK/NC 1100, Breton S.p.A.,ISO 9001:2000, Cert. N. 0056, 16 pages (Admitted as prior art as of Mar. 16, 2007).
Spiderbreton FRPC 700/1200, Breton S.p.A., ISO 9001, Cert. N. 0056, 6 pages (Admitted as prior art as of Mar. 16, 2007).
Stone, pp. 1-54 (Feb. 1993).
StoneJET—The Only with Bridge Sawing and Water JET, 1 pages (Admitted as prior art as of Mar. 16, 2007).
Taormina "2", Officina Meccanica Antonino Mantello, 2 pages (Admitted as prior art as of Mar. 16, 2007).

* cited by examiner

MATERIAL LOADING APPARATUS

CROSS REFERENCE TO RELATED APPLICATION

The present patent application is a continuation of U.S. patent application Ser. No. 15/000,764, filed Jan. 19, 2016, now U.S. Pat. No. 10,201,914; which claims the benefit of U.S. Provisional Patent Application Ser. No. 62/105,533, filed Jan. 20, 2015, which patent application is hereby incorporated by reference in its entirety.

TECHNICAL FIELD

The present disclosure relates generally to machines for cutting/shaping various materials including stone and other materials. More particularly, the present disclosure relates to a material loading apparatus for use on such machines.

BACKGROUND

Various machines such as CNC router machines for cutting or shaping stone and similar materials are known in the art. Workpieces to be fabricated are placed on work tables of the machines and any number of predetermined cutting/routing operations are carried out. Stone workpieces are often heavy and cumbersome to load onto the work table. Because of this, safety during the loading and unloading of the stone workpieces is a concern. Additionally, preventing damage to the stone workpieces and the router machines, caused by loading the workpieces is also a concern.

Improvements and alternatives in material loading for use in cutting/shaping machines such as CNC routing machines are desired.

SUMMARY

One aspect of the present disclosure is a material loading apparatus that includes a fixed frame. The material loading apparatus also includes a movable support surface pivotally mounted to the frame. The support surface is configured for supporting the material. The material loading apparatus also includes a first link extending between the support surface and the frame. The first link is pivotally connected to the support surface at a first end of the first link and pivotally connected to the frame at a second end of the first link. The material loading apparatus also includes a second link extending between the support surface and the frame. The second link is pivotally connected to the support surface at a first end of the second link and pivotally connected to the frame at a second end of the second link. The material loading apparatus also includes an actuator pivotally connected to the frame. The actuator is configured to move the support surface between a generally horizontal position and a generally vertical position.

Another aspect is a material loading apparatus that includes a fixed frame. The material loading apparatus also includes a movable support surface pivotally mounted to the frame. The support surface is configured for supporting the material. The material loading apparatus also includes a first link extending between the support surface and the frame. The first link is pivotally connected to the support surface at a first end of the first link and pivotally connected to the frame at a second end of the first link. The material loading apparatus also includes a second link extending between the support surface and the frame. The second link is pivotally connected to the support surface at a first end of the second link and pivotally connected to the frame at a second end of the second link. The material loading apparatus also includes an actuator pivotally connected to the frame. The actuator is configured to move the support surface between a generally horizontal position and a generally vertical position. The material loading apparatus also includes a fluid tank positioned under the support surface when the support surface is in the generally horizontal position.

A further aspect of the present disclosure is a stone shaping machine. The stone shaping machine includes a material loading apparatus. The material loading apparatus includes a fixed frame. The material loading apparatus also includes a movable support surface pivotally mounted to the frame. The support surface is configured for supporting the material. The material loading apparatus also includes a first link extending between the support surface and the frame. The first link is pivotally connected to the support surface at a first end of the first link and pivotally connected to the frame at a second end of the first link. The material loading apparatus also includes a second link extending between the support surface and the frame. The second link is pivotally connected to the support surface at a first end of the second link and pivotally connected to the frame at a second end of the second link. The material loading apparatus also includes an actuator pivotally connected to the frame. The actuator is configured to move the support surface between a generally horizontal position and a generally vertical position. The material loading apparatus also includes a fluid tank positioned under the support surface when the support surface is in the generally horizontal position. The stone shaping machine also includes a movable cutting apparatus positioned for shaping material supported by the support surface of the material loading apparatus when the support surface is in the generally horizontal position. The cutting apparatus is movable along a length and a width of the support surface. The cutting apparatus is also movable in a vertical direction toward and away from the support surface.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

DETAILED DESCRIPTION

Figure 1:
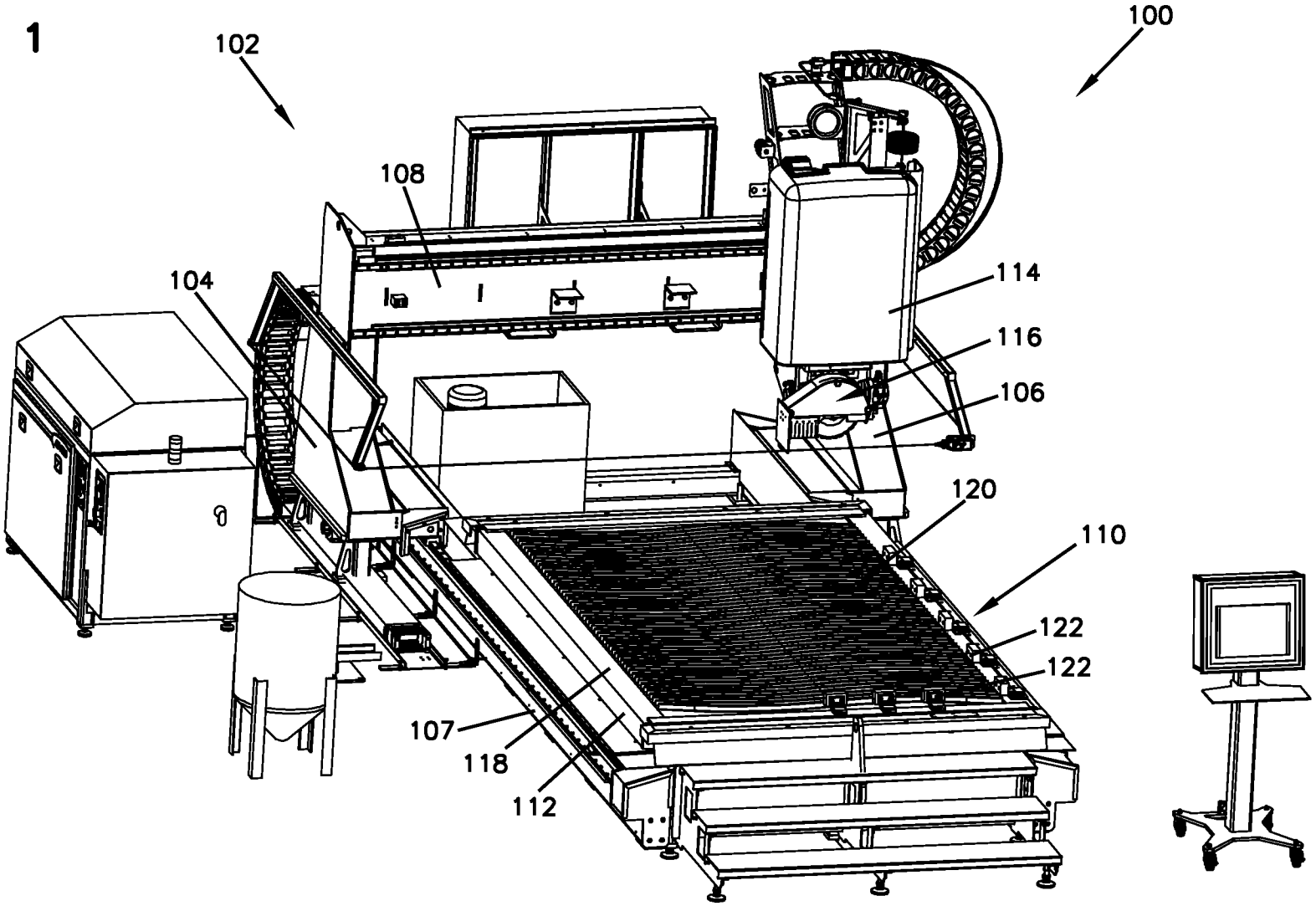
FIG. 1 illustrates a perspective view of a stone shaping system when the support surface is in the generally horizontal position, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 illustrates a stone shaping system 100 in accordance with the principles of the present disclosure. The stone shaping system 100 includes a gantry assembly 102, a first support member 104, a second support member 106, a bridge 108, a work table 110, a fluid tank 112, a motor-driven carriage 114, and a cutting assembly 116.

In certain embodiments, the stone shaping system 100 may be used in the machining of articles manufactured from stone, glass, ceramic, metallic or other materials. In some embodiments, the stone shaping system 100 may be of the gantry-type cutting machines known in the art. The features of a gantry-type cutting machine are shown in FIG. 1.

In one embodiment, the stone shaping system 100 generally includes the gantry assembly 102 that includes the first support member 104, the second support member 106, and the bridge 108 extending longitudinally and configured to move transversely with respect to the work table 110. In some embodiments, the support members 104, 106 can travel along tracks 107 that are positioned alongside the work table 110.

It should be noted that, although the stone shaping system 100 is depicted as a gantry-type cutting machine, the inventive aspects of the disclosure also apply to fixed-type bridge machines that do not move along gantry supports. For example, in a fixed-bridge machine, the bridge may be constrained to move in the vertical direction, rather than the transverse direction, with respect to the gantry supports. A carriage may be mounted on the bridge and travel along the bridge.

Figure 3:
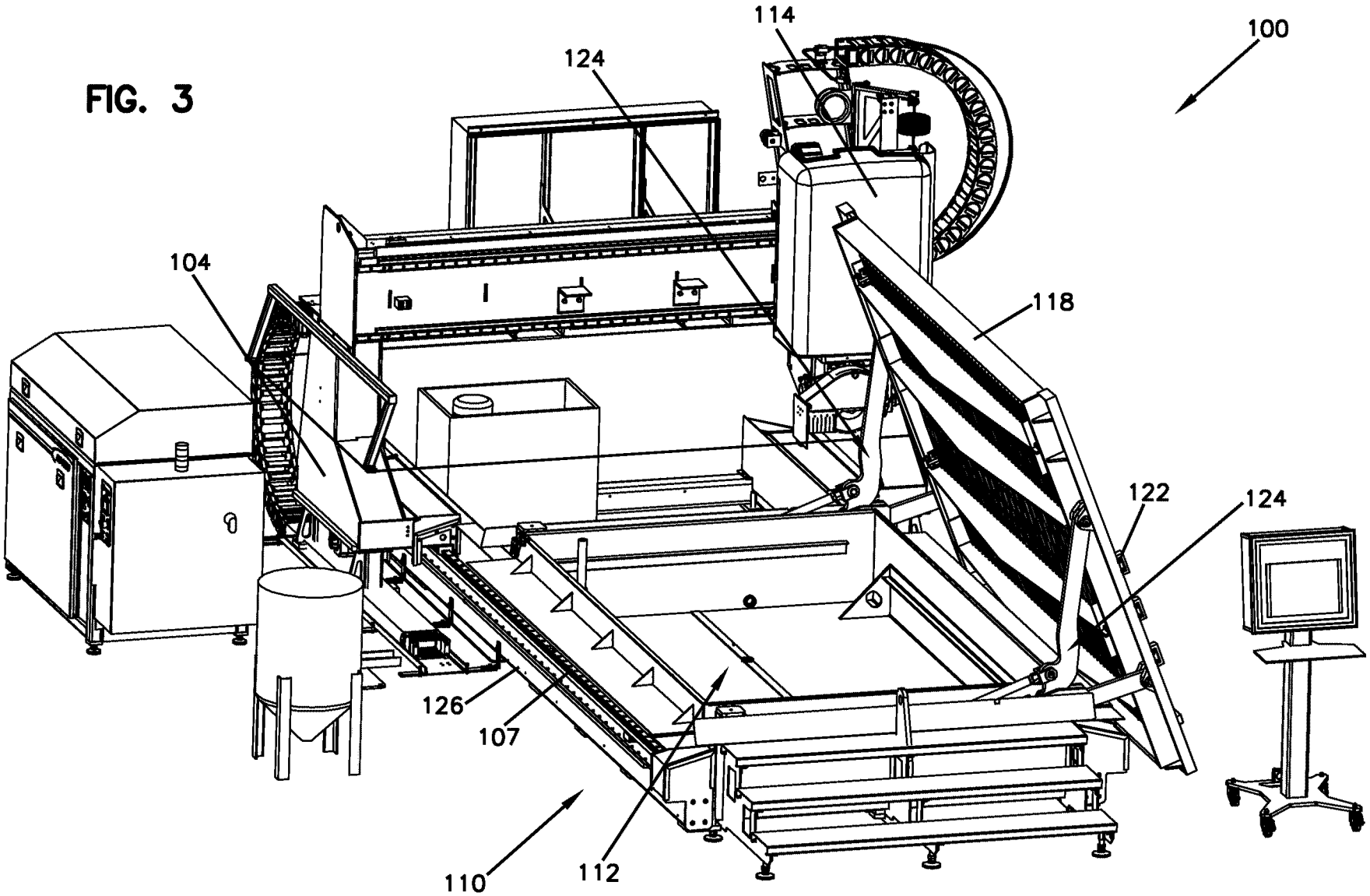
FIG. 3 illustrates a perspective view of the stone shaping system shown in FIG. 1 when the support surface is in the generally vertical position.

The work table 110 includes a support surface 118 that is configured to hold a workpiece (e.g. a slab of stone). In some embodiments, the stone shaping system 100 may be a waterjet based cutting system, and the support surface 118 can be configured to allow fluid to pass through the support surface 118. In some embodiments, the support surface 118 includes a grid 120. In the depicted embodiment, the support surface 118 is positioned to substantially cover the fluid tank 112, specifically the top of the fluid tank 112. The grid 120 is configured to allow fluid to pass through the grid 120 and into the fluid tank 112 while preventing large particles from passing through the grid 120 and entering the fluid tank 112 during the cutting process. In some embodiments, the work table 110 is configured to be maneuverable to aid in the loading and unloading of a workpiece from the work table 110, specifically, the support surface 118. In such an embodiment, the support surface 118 is maneuverable between a substantially horizontal position (as shown in FIG. 1) and a substantially vertical position (as shown in FIG. 3). As shown, the support surface 118 includes a plurality of workpiece retaining elements 122 that are positioned at the edge of the support surface 118. The workpiece retaining elements 122 are configured to help retain the workpiece on the support surface 118 when the support surface 118 is moving or tilted at an angle with respect to the ground.

The fluid tank 112 is configured to hold water that has been used in the cutting process. In some embodiments, as discussed before, water may be used as a cutting tool (e.g., a waterjet). In other embodiments, water is used to help reduce dust and provide a coolant to a cutting tool (e.g., a rotary saw). Over time, small particulates from the cutting process can be carried by the water, through the grid 120, and accumulate within the fluid tank 112. Because of this, the fluid tank 112 requires maintenance to remove built up particulates. The fluid tank 112 can also include a drain (not shown).

In the depicted embodiment, the bridge 108 has mounted thereon a motor-driven carriage 114 which supports the cutting assembly 116. The carriage 114 is configured to move longitudinally with respect to the bridge 108 over the work table 110, in a direction perpendicular to the direction of the movement of the bridge 108. The depicted carriage 114 is known in the art, being of the type used in conventional numerically controlled or non-numerically controlled, manual cutting machines.

Still referring to FIG. 1, cutting assembly 116 is configured to shape a workpiece on the support surface 118 of the work table 110. The cutting assembly 116 is configured to move toward and away from the support surface 118 when the support surface 118 is in a substantially horizontal position, as depicted. In some embodiments, the cutting assembly 116 includes a rotary tool, such as a circular saw, for cutting linear lines. In other embodiments, the cutting assembly 116 includes a waterjet to cut linear lines and curves. In still other embodiments, the cutting assembly 116 includes both a waterjet and a rotary tool.

Figure 2:
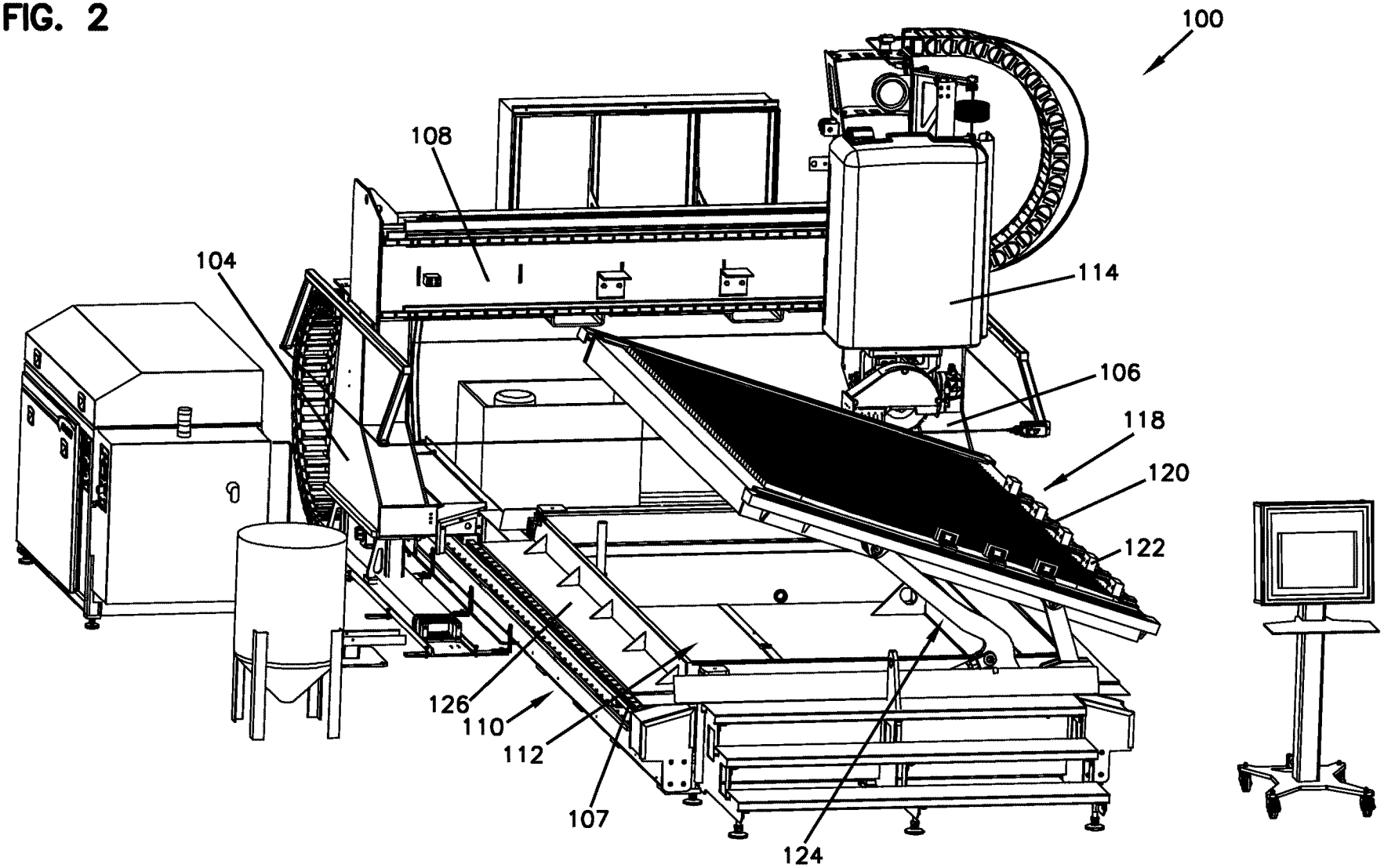
FIG. 2 illustrates a perspective view of the stone shaping system shown in FIG. 1 when the support surface is in an intermediate position.

FIG. 2 illustrates the stone shaping system 100 with the support surface 118 of the work table 110 in an intermediate position, in accordance with the principles of the present disclosure. FIG. 3 illustrates the stone shaping system 100 with the support surface 118 of the work table 110 in the generally vertical position, in accordance with the principles of the present disclosure.

As shown in FIGS. 2-3, when the support surface 118 moves from the substantially horizontal position (as shown in FIG. 1), access to the fluid tank 112 is facilitated. This movement of the support surface 118 is facilitated by an actuator operated loading system 124 (shown in more detail in FIGS. 5-9). Such a loading system 124 saves time for the operator if access needs to be gained to the fluid tank 112, as the support surface 118 can swiftly be removed from the top of the fluid tank 112.

The loading system 124 is configured to simultaneously pivot and translate the support surface 118 with respect to a frame 126 of the work table 110. The frame 126 is the portion of the work table 110 that is fixedly located on the ground and holds the fluid tank 112 and the support surface 118. The loading system 124 allows for smooth movement of the support surface 118 from the generally horizontal position (FIG. 1) to the generally vertical position (FIG. 3), and vice versa. Due to the heavy weight of workpieces that the support surface 118 is configured to receive, the loading system 124 must ensure a smooth movement to and from the generally vertical position so as to help prevent the unsettling of the workpiece on the support surface 118. If the loading system 124 moves at too fast of a rate, or makes sudden quick movements, the workpiece on the support surface 118 could become a safety hazard to anyone near a stone shaping system 100. In some embodiments, the loading system 124 can be operated remotely.

In the depicted embodiment, the loading system 124 is positioned along the width of the support surface 118. In other embodiments, the loading system 124 can be positioned along the length of the support surface 118.

As shown in FIG. 3, when in the generally vertical position, the support surface 118 is configured to receive a workpiece. In some embodiments, a separate loading machine facilitates the movement of the workpiece onto the support surface 118. In some embodiments, the loading machine is configured to move the workpiece in a generally vertical or upright orientation. Once the workpiece is on the support surface 118, the workpiece retaining elements 122 of the support surface 118 are configured to hold the workpiece in place in a generally vertical orientation on the support surface 118.

Figure 4:
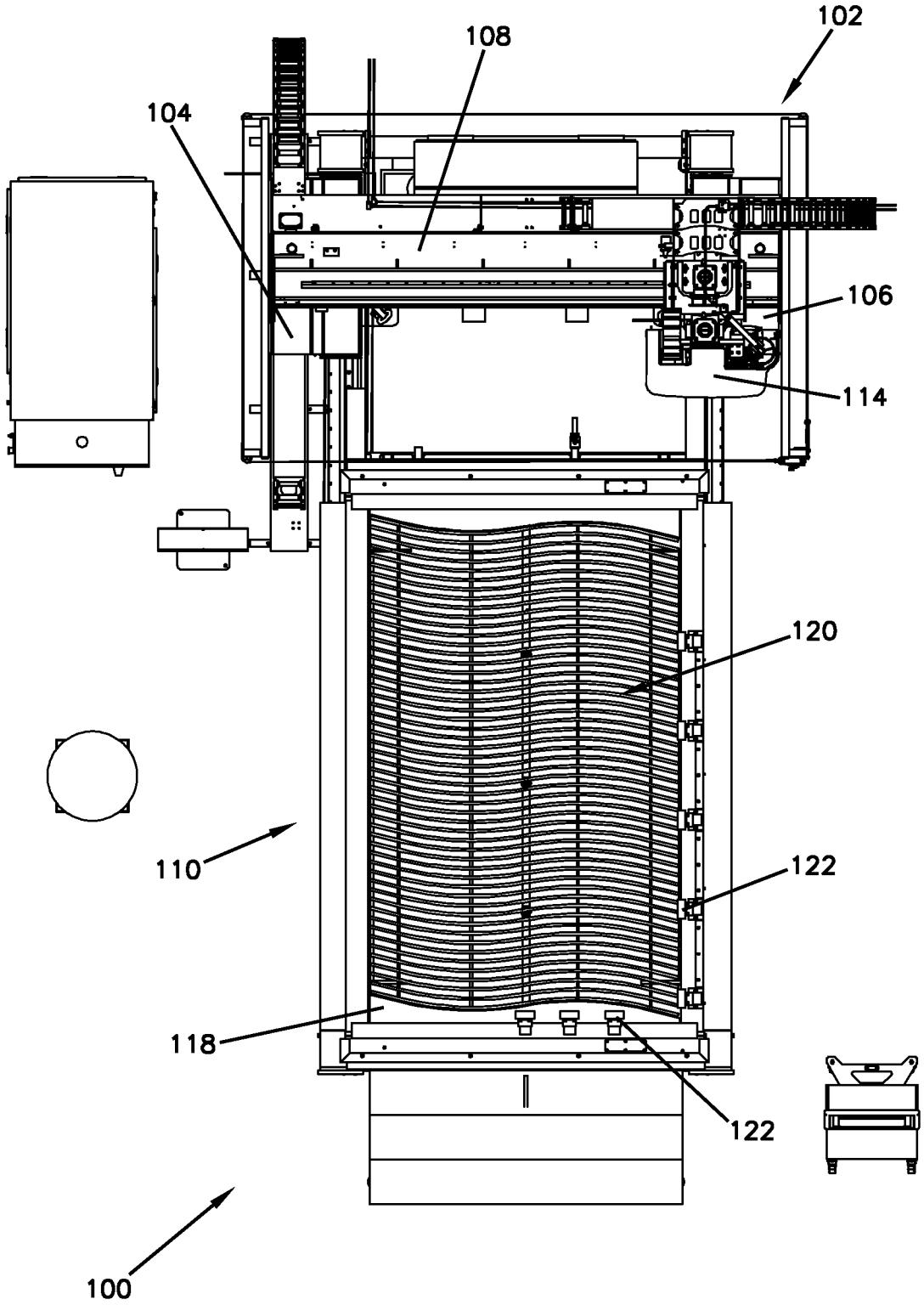
FIG. 4 illustrates a top view of the stone shaping system shown in FIG. 1 when the support surface is in the generally horizontal position.

FIG. 4 shows a top view of the stone shaping system 100. The support surface 118 is shown in the generally horizontal position. As show, the grid 120 is configured to allow water to pass through the grid and fall into the fluid tank 112 positioned under the grid 120.

In the depicted embodiment, the gantry assembly 102 is configured to travel above the work table 110 during the cutting process. During the loading and unloading of a workpiece from the support surface 118, the gantry assembly 102 is configured to be positioned in a way so as not to interfere with the movement of the support surface 118 to and from the generally horizontal position and the generally vertical position. In the depicted embodiment, the gantry assembly 102 is positioned at the back of the work table 110 during loading and unloading. In other embodiments, the gantry assembly 102 is configured to position the bridge 108 high enough above the support surface 118 so that the bridge 108, and support members 104, 106, do not interfere with the support surface 118 when the support surface 118 is moving between the generally horizontal position and the generally vertical position.

Figure 5:
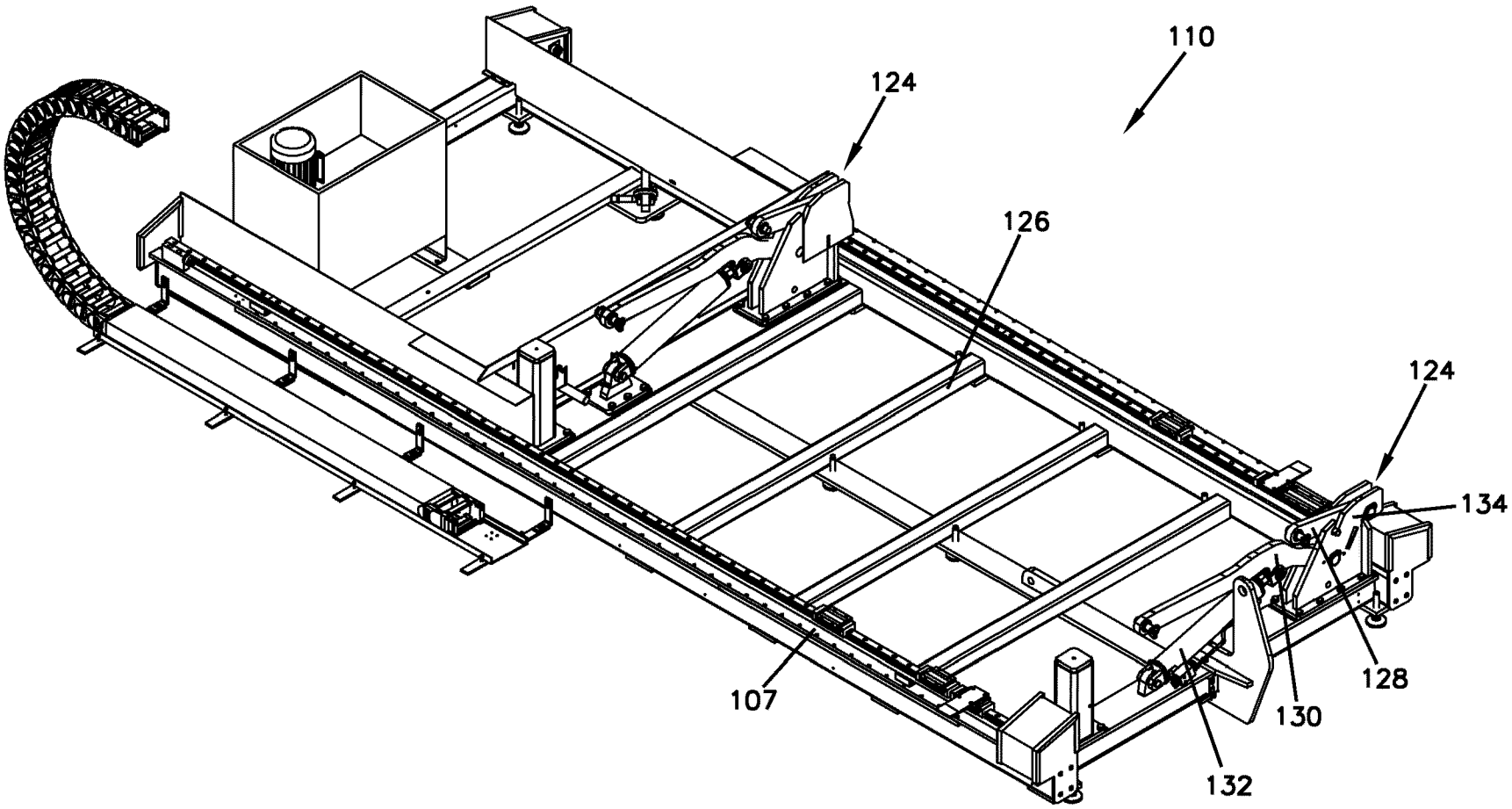
FIG. 5 illustrates a perspective view of a portion of the work table shown in FIG. 1.

FIG. 5 shows a portion of the work table 110. The depicted portion of the work table 110 includes the frame 126 and loading system 124 for the support surface 118.

The loading system 124 is configured to be attached to both the frame 126 of the work table 110 and the support surface 118 of the work table 110.

Figure 6:
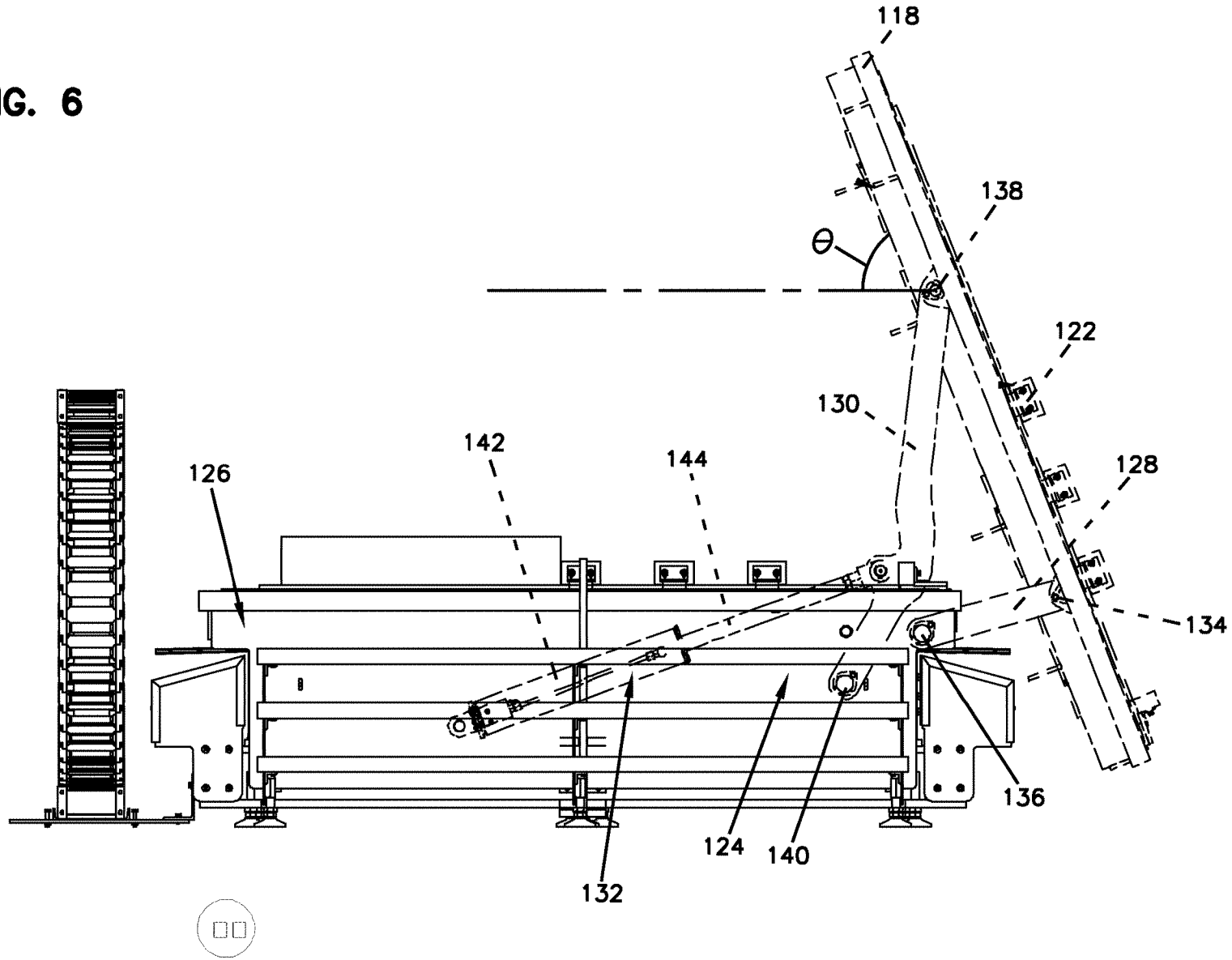
FIG. 6 illustrates a schematic side view of the portion of the work table shown in FIG. 5.

The loading system 124 includes a first link 128, a second link 130, and an actuator 132. In the depicted embodiment, the loading system 124 also includes a link mount 135. The first and second links 128, 130 are configured to be pivotally attached to both the frame 126 and the support surface 118 (as shown in FIG. 6). In the depicted embodiment, the first and second links 128, 130 are pivotally attached to the link mount 135, which is secured to the frame 126. Also, in the depicted embodiment, the actuator 132 is pivotally connected to the frame 126 and the second link 130.

FIG. 6 is a view of one side of the work table 110. The support surface 118 is shown in the generally horizontal position and the generally vertical position (shown by the broken lines). Due to the configuration of the loading system 124, the support surface 118 does not overhang any edge of the work table 110 when in the generally horizontal position. However, the loading system 124 does allow the support surface 118 to pivot and translate with respect to the frame 126 of the work table 110. This movement allows for the support surface 118 to be positioned outside of the edge of the work table 110, and close to the ground, so as to allow easy loading and unloading of a workpiece from the support surface 118.

When in the generally vertical position, the support surface 118 is at an angle θ from the generally horizontal position of the support surface 118. During the movement between the generally horizontal position and the generally vertical position, angle θ can be between about 0° and about 70°. In some embodiments, when in the generally vertical position, the support surface 118 is about 70° from the generally horizontal position.

In the depicted embodiment, the first link 128 of the loading system 124 is pivotally connected at a first end 134 of the first link 128 to the support surface 118. Additionally, at an opposite second end 136 of the first link 128, the first link 128 is pivotally connected to the frame 126 of the work table 110. In the depicted embodiment, the first link 128 is a bar.

The second link 130 of the loading system 124 is pivotally connected at a first end 138 to the support surface 118. Additionally, at a opposite second end 140 of the second link 130, the second link 130 is pivotally connected to the frame 126 of the work table 110. In the depicted embodiment, the second link 130 is a bar. In some embodiments, the second link 130 is configured to accommodate the actuator 132. In some embodiments, the second link 130 is positioned at a location behind the first link 128 in a front to back direction.

Both the first and second links 128, 130 are configured to dictate the path of the support surface 118 when moved from the generally horizontal position to the generally vertical position.

The actuator 132 has a body 142 and a ram 144. In some embodiments, the actuator 132 can be a hydraulic actuator. In other embodiments, the actuator 132 is a pneumatic actuator. The actuator 132 can be powered by an external pump (not shown). In the depicted embodiment, the ram 144 of the actuator 132 is pivotally connected to the second link 130 of the loading system 124 at a location between the first end 138 and the second end 140 of the second link 130.

The actuator 132 is configured to supply a force necessary to move the support surface 118 from the generally horizontal position to the generally vertical position. The actuator 132 can supply the force to different locations on the support surface 118. In the depicted embodiment, the actuator 132 supplies a force to the second link 130. In some embodiments, the actuator 132 is controlled by an external control station. In other embodiments, the actuator 132 is controlled by a remote.

In some embodiments, the loading system 124 of the work table 110 includes a second set of first and second links 128, 130 and an actuator 132 positioned at the opposite side of the work table 110 from the first set. In such an embodiment, the second set is substantially similar to the first set (as shown in FIG. 6).

Figure 7:
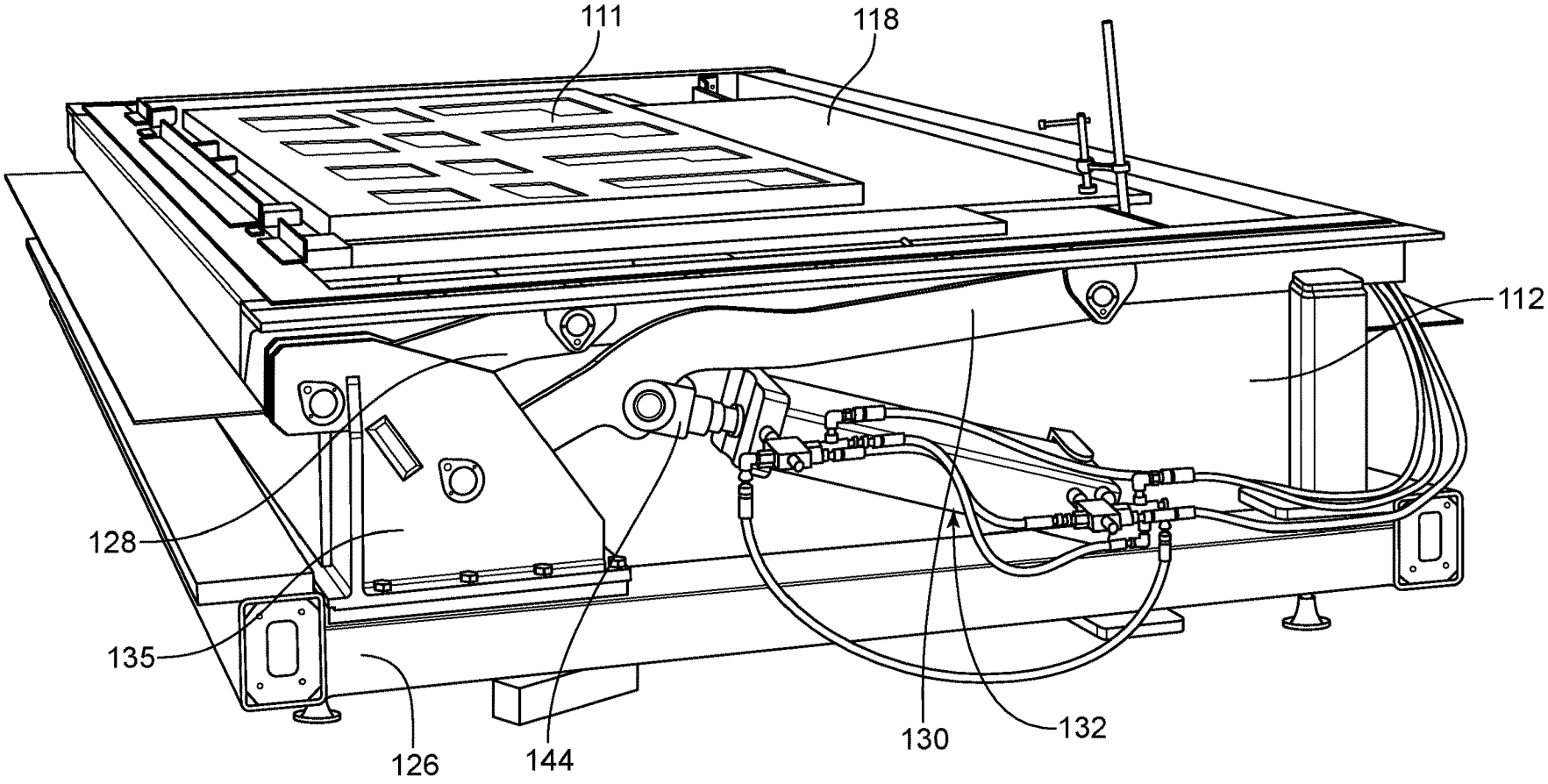
FIG. 7 illustrates a perspective view of the work table shown in FIG. 1 when the support surface is in the generally horizontal position.
Figure 8:
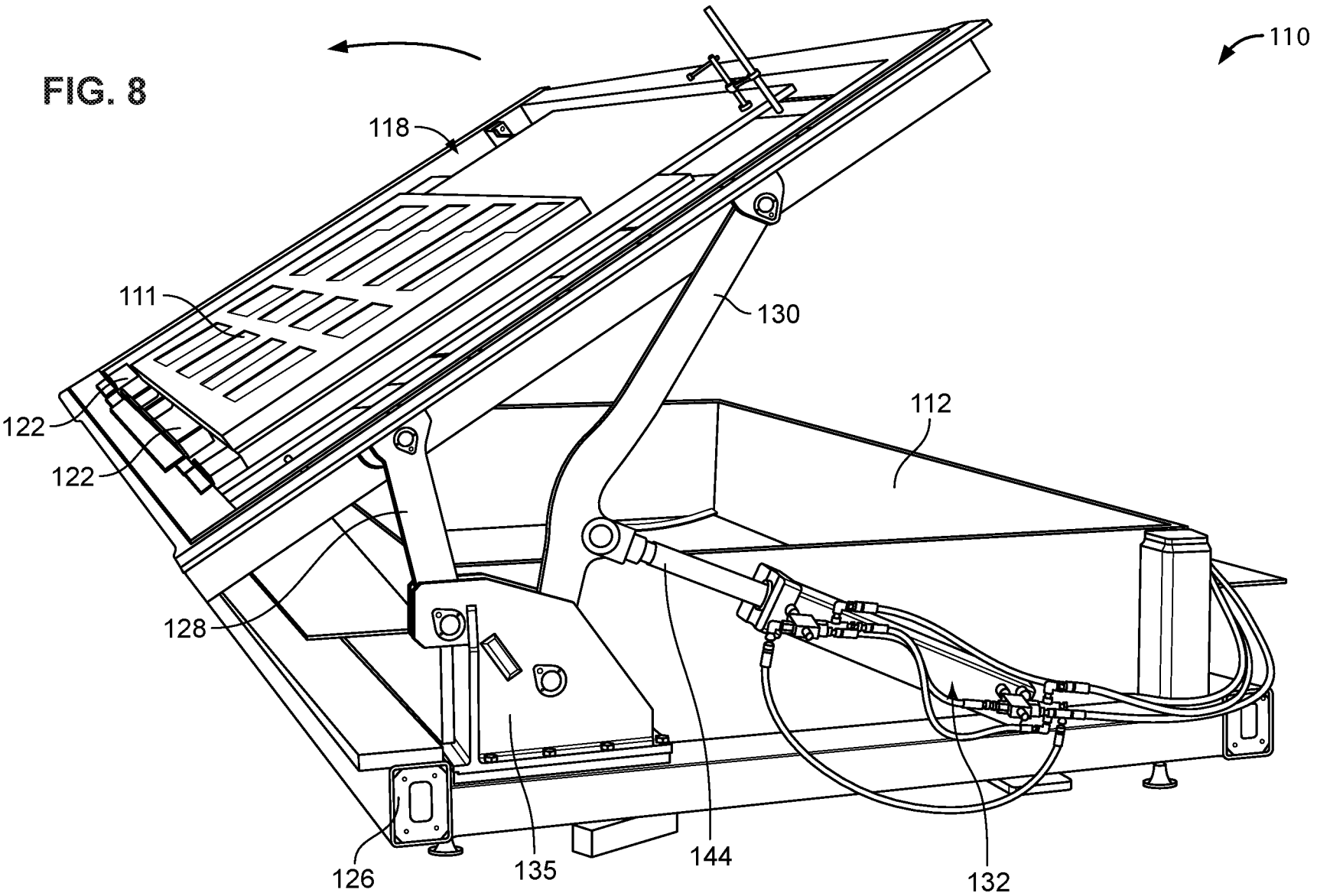
FIG. 8 illustrates a perspective view of the work table shown in FIG. 1 when the support surface is in an intermediate position.
Figure 9:
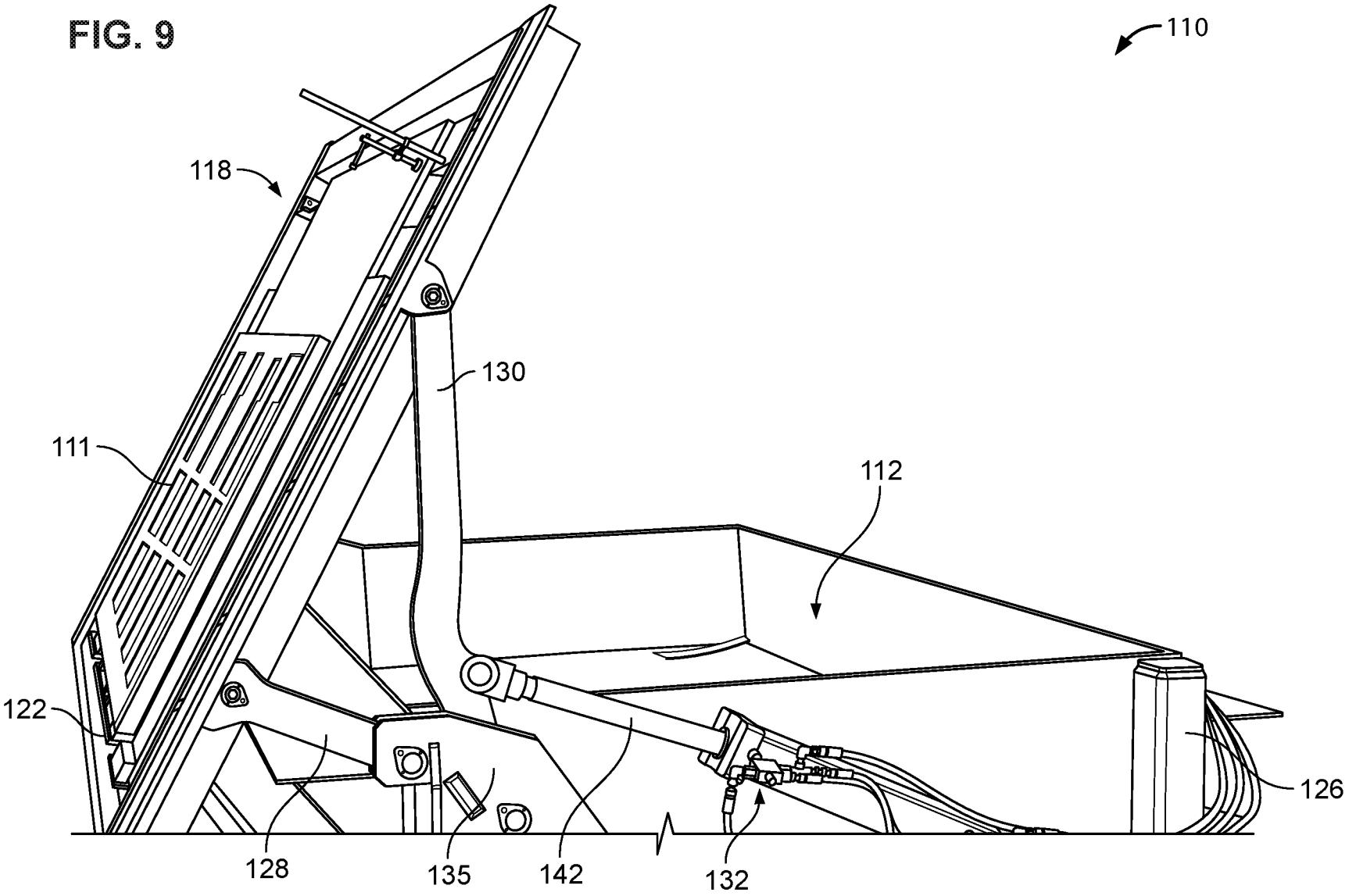
FIG. 9 illustrates a perspective view of the work table shown in FIG. 1 when the support surface is in the generally vertical position.

FIGS. 7-9 depict the work table 110 in isolation. FIG. 7 shows the support surface 118 in the generally horizontal position. FIG. 8 shows the support surface 118 in an intermediate position between the generally horizontal position and the generally vertical position. FIG. 9 shows the support surface 118 in the generally vertical position.

The support surface 118 is shown supporting a workpiece 111. As the support surface 118 moves between the generally horizontal position and the generally vertical position, and vice versa, the workpiece retaining elements 122 help to maintain the workpiece 111 on the support surface 118. In some embodiments, the support surface 118 is configured to hold a plurality of workpieces 111.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A stone shaping machine comprising:

a) a material loading apparatus including:

a fixed frame;

a movable support surface pivotally mounted to the frame, the support surface configured for supporting the material;

a first link extending between the support surface and the frame, the first link pivotally connected to the support surface at a first end of the first link and pivotally connected to the frame at a second end of the first link;

a second link extending between the support surface and the frame, the second link pivotally connected to the support surface at a first end of the second link and pivotally connected to the frame at a second end of the second link; and an actuator pivotally connected to the frame, the actuator being configured to move the support surface between a generally horizontal position and a generally vertical position; and a fluid tank positioned generally under the support surface of the material loading apparatus when the support surface is in the generally horizontal position; and b) a movable cutting apparatus positioned for shaping material supported by the support surface of the material loading apparatus when the support surface is in the generally horizontal position, wherein the cutting apparatus is movable along a length and a width of the support surface, and wherein the cutting apparatus is also movable in a vertical direction toward and away from the support surface.

2. The stone shaping machine of claim 1, wherein the support surface defines a table top for the stone shaping machine.

3. The stone shaping machine of claim 1, wherein the moveable cutting apparatus includes a waterjet.

4. The stone shaping machine of claim 1, wherein the movable cutting apparatus is secured to a bridge, the bridge being positioned to straddle the support surface.

5. The stone shaping machine of claim 1, wherein the fluid tank has an open top, and wherein, when in the generally horizontal position, the support surface covers the open top of the fluid tank, and wherein, when in the generally vertical position, the open top of the fluid tank is accessible.

* * * * *